US005822813A

United States Patent [19]

Powell

[11] Patent Number: 5,822,813

[45] **Date of Patent: *Oct. 20, 1998**

[54] MOTION COMPENSATED APPARATUS

[76] Inventor: Tyrone E. Powell, 2000 Otter, Anchorage, Ak. 99504

[ * ] Notice: This patent issued on a continued prosecution application filed under 37 CFR 1.53(d), and is subject to the twenty year patent term provisions of 35 U.S.C. 154(a)(2).

[21] Appl. No.: 556,810

[22] Filed: Nov. 2, 1995

[51] Int. Cl.[6] ..... A47C 17/64

[52] U.S. Cl. ..... 5/118; 5/131; 248/550; 248/562

[58] Field of Search ..... 248/550, 188.3, 248/588, 562, 583, 573, 584, 182.1, 346.05; 5/131, 2.1, 118

[56] References Cited

U.S. PATENT DOCUMENTS

| | | | |
|---|---|---|---|
| 2,926,879 | 3/1960 | Dietrich | 248/311 |
| 3,122,257 | 2/1964 | Soehrman | 215/100 |
| 3,371,359 | 3/1968 | Dome | 5/118 |
| 3,703,999 | 11/1972 | Forys et al. | 248/550 |
| 4,033,541 | 7/1977 | Malueg | 248/550 |
| 4,157,812 | 6/1979 | Bennett | 254/172 |
| 4,180,362 | 12/1979 | Stair | 414/139 |
| 4,198,025 | 4/1980 | Lowe et al. | 248/550 |
| 4,267,737 | 5/1981 | O'Connor et al. | 74/5.47 |
| 4,474,354 | 10/1984 | Field | 248/596 |
| 4,477,045 | 10/1984 | Karasawa | 248/550 |
| 4,635,892 | 1/1987 | Baker | 248/550 |
| 4,747,489 | 5/1988 | Saalfeld | 206/446 |
| 4,926,188 | 5/1990 | More et al. | 343/719 |
| 4,979,248 | 12/1990 | Kelley | 5/118 |
| 5,046,721 | 9/1991 | Altare | 272/36 |
| 5,186,424 | 2/1993 | Shultz et al. | 248/179 |
| 5,195,198 | 3/1993 | Travis | 5/618 |
| 5,285,995 | 2/1994 | Gonzalez | 248/550 |
| 5,288,043 | 2/1994 | Tigliev | 248/123.1 |
| 5,342,244 | 8/1994 | Nelson | 472/14 |
| 5,346,242 | 9/1994 | Karnopp | 280/707 |
| 5,359,337 | 10/1994 | Eguchi | 343/765 |
| 5,396,815 | 3/1995 | Polites et al. | 74/61 |
| 5,410,327 | 4/1995 | Shakun et al. | 343/765 |
| 5,536,059 | 7/1996 | Amirouche | 248/550 |
| 5,587,900 | 12/1996 | Bullen | 248/550 |

OTHER PUBLICATIONS

George Wahington University Course "Motion Stabilization Systems for Mobile Platforms".

Rocking Horse™ Balanced Yacht Systems Ad.

*Primary Examiner*—Leslie A. Braun
*Assistant Examiner*—Gwendolyn Baxter
*Attorney, Agent, or Firm*—Clifford Kraft

[57] ABSTRACT

A motion compensated apparatus that can be used as a sleeping platform, stabilizer. The discomfort and danger of a moving surface associated with a ship at sea is well known. The motion of such a surface causes considerable distress in humans and animals. Servos can expand and contract to position the upper portion of the assembly at various angles with respect to the lower portion and to cancel accelerations caused by pitching and rolling. The servos can be controlled by a control system that is driven by a set of motion sensors or a gyro. The sensors or gyro sense the instantaneous position of the deck with respect to an absolute level virtual reference plane. The control system continuously adjusts the apparatus to remain parallel to the absolute level plane. The system contains a quick enough response to track the fast motion encountered on a ship to yield a smooth and comfortable ride according to control system principles. The sensors may comprise accelerometers, gyros, ring gyros, or other methods of sensing the deviation of the deck or platform from a reference level plane.

7 Claims, 7 Drawing Sheets

MOTION COMPENSATED APPARATUS

BACKGROUND

1. Field of the Invention

This invention relates generally to the field of motion compensation and more particularly to a motion compensated apparatus that can be used as a sleeping platform, a chair, or a cargo stabilizer.

1. Description of the Related Art

The discomfort and danger of a moving surface associated with a ship at sea or a train or other vehicle is well known. The motion of such a surface causes considerable distress in humans and animals and may cause damage to sensitive cargo, even if the cargo is secured. An example of such sensitive cargo might be a valuable painting or museum artifact.

In addition to simple discomfort, humans and animals may experience motion sickness in such an environment. Motion sickness has ruined cruises for many steamship passengers since even motion stabilized large vessels may experience considerable rolling and pitching in high seas.

Precious sensitive cargo may be damaged when a ship rolls beyond a certain point or pitches excessively. The military has long recognized the necessity of stabilizing weapons platforms and satellite antennas; however, no attempt has been made to stabilize humans or sensitive cargo. Cargo is usually simply secured to a ship's deck with lines. In the case of trains and trucks, cargo is usually loosely packed or, in some cases, secured. In no cases are humans or animals stabilized or prevented from experiencing the vehicle's or ship's motion. Discomfort on a ship or train is a way of life. In many cases motion sickness is a result. However, even when the motion is not severe enough to cause motion sickness, or the individual is not susceptible to it, the motion causes loss of sleep or a general feeling of discomfort.

Personnel on military ships, cargo ships, trains, and trucks simply accept the discomfort and possible danger. In the case of truck drivers, the truck motion is known to cause various chronic ailments over long periods of exposure.

What is badly needed is a motion stabilized platform or apparatus for cargo, human or animal passengers, or a motion stabilized seat for comfort or prevention of motion sickness or chronic disorders in the case of truck drivers.

Such a motion stabilized apparatus would automatically adjust to compensate for motion of the vehicle or ship. It would consist of a part that was kept level by servos. This part would be mounted on a swivel or universal gimbal. However, since the center of gravity would not necessarily remain in the center of the apparatus, the servos would continuously re-adjust to compensate not only for the motion of the vehicle or ship, but also for any shift in the center of gravity of the load. In the case of a sleeping platform for a human or animal, this action would allow ingress and egress at will without tipping or upsetting.

A set of sensors would sense the instantaneous deviation of the vehicle deck or floor from a reference level plane and, through a control system, cause the servos or positioners to compensate so that the apparatus remained parallel to the reference plane.

An alternative method would be to have a system mounted on gimbals that is either kept centered by gravity or contains a rotating gyroscopic mass that maintains stability.

Such a device could be used to ship sensitive cargo, protect truck drivers from long-term injury, prevent motion sickness, or simply provide comfort. On a ship, the device, as sleeping platforms, could be offered to passengers who were particularly motion sensitive, or to those desiring a good night's sleep. Such a apparatus could be an attractive feature of a first class ticket. A motion compensated apparatus would also be very desirable in sick bay. In fact it is possible to envision an entire emergency operating suite positioned on board a large version of such a apparatus.

SUMMARY OF THE INVENTION

The present invention relates to a motion compensated apparatus that can be used to stabilize its contents in an unstable situation such as that encountered on a ship at sea, on land transport vehicles, and in any other motion environment. The motion compensated apparatus can be a sleeping or sitting platform for a human or animal, or it can be a stabilized cargo carrier for motion sensitive cargo. It can take the form of a platform or other shape such as a bathtub for keeping water from sloshing.

The apparatus is used in an environment where rolling and pitching motion would normally cause its contents to shift, or in the case of a human or animal, to feel discomfort or even get motion sickness. One embodiment consists of a lower portion that is firmly seated on the moving surface and an upper portion that is free to swivel in relation to the moving surface. The upper portion can be mounted on a free motion gimbal or any other type of free swivel mechanism.

The lower portion of the assembly can contain servos or positioners placed to positively control the relationship between the two parts. In a fully coupled embodiment, there can be four or more such servos. The servos can expand and contract to position the upper portion of the assembly at various angles with respect to the lower portion.

The servos can be controlled by a control system that is driven by a set of motion sensors or a gyro. The sensors or gyro sense the instantaneous position of the surface or deck with respect to an absolute level virtual reference plane. The control system continuously adjusts the apparatus to remain parallel to the absolute level plane. The system contains a quick enough response to track the fast motion encountered in a truck or train with enough damping to yield a smooth and comfortable ride according to control system principles. The sensors may comprise accelerometers, gyros, ring gyros, or other methods of sensing the deviation of the deck or platform from a reference level plane.

Another embodiment of the present invention is in the form of a chair. Here a human or animal is placed in the chair, and the chair is caused to remain level with respect to a reference level plane. Such a chair can be used as a comfort device on a rolling ship or a device to prevent motion sickness.

Still another embodiment of the present invention is an air evacuated rectangular box with a partially spherical bottom. This box is mounted on a spherical bearing comprising smaller ball bearings. The lower half of the bearing is mounted onto a column which is firmly attached to the deck or floor that will experience motion. The upper box is free to swivel in all directions on the spherical bearing. Inside the evacuated box is a large gyroscopic spinning mass. This mass can be in the shape of a disk. This mass is made to spin with a friction drive motor. The gyroscopic action of this mass keeps the box in a preset position as the deck or floor rolls to any angle. This embodiment of the invention does not require sensors or servos, but rather maintains its reference position directly due to the gyroscopic action of the rotating mass.

Another embodiment relates to a gimbal mounting firmly attached to the overhead of a compartment that is equipped with a suspended platform. Such a system can be equipped with liquid or other types of motion dampers.

BRIEF DESCRIPTION OF THE DRAWINGS

For a more complete understanding of this invention, reference should now be made to the embodiments illustrated in greater detail in the accompanying drawings and descriptions below by way of examples of the invention.

It should be understood, of course, that the invention is not necessarily limited to the particular embodiments illustrated herein.

DESCRIPTION OF PREFERRED EMBODIMENTS

Figure 1:
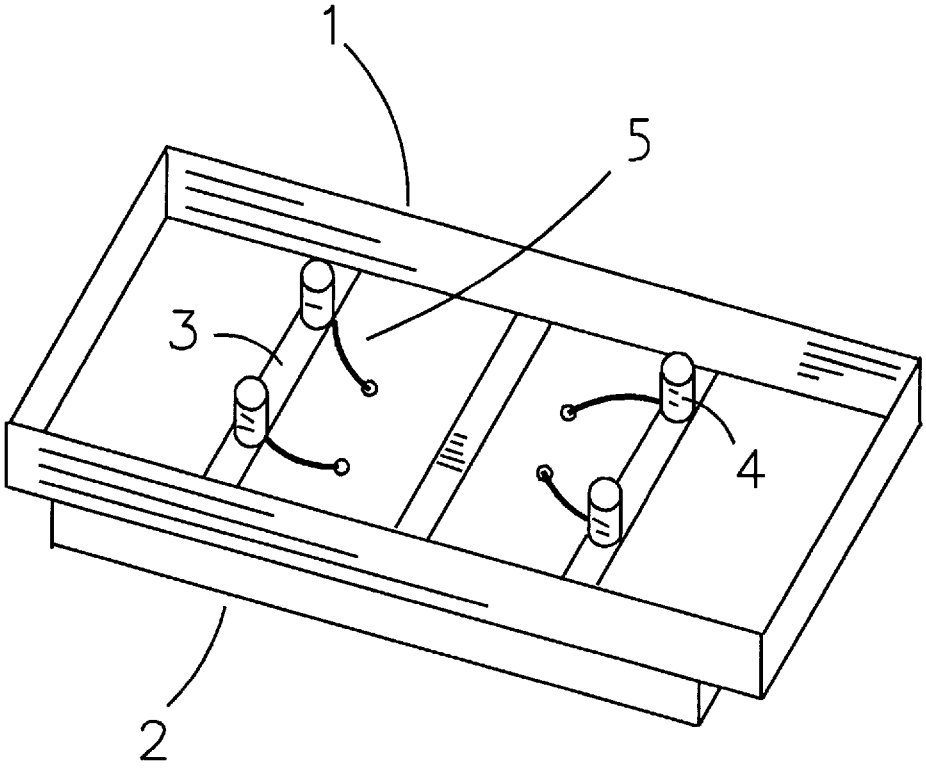
FIG. 1 shows a perspective view of an embodiment of the invention which could form a sleeping platform.

A perspective view of an embodiment of the present invention is found in FIG. 1. Here the frame of the apparatus 1 is shown mounted to a base portion 2. A bearing surface (not shown) for holding cargo or a human or animal is contained in the frame 1. In the case of a human, where the apparatus is used as a sleeping platform, this can be a conventional mattress mounted on a platform. In the case where the present invention is used as a cargo carrier, the bearing surface can be a table or other surface where cargo is mounted or placed. This type of surface can be flat or concave. It can be a flat surface enclosed by sides, or it can be a box type container. The frame 1 is held together by cross supports 3, which in turn are used to mount a system of servos 4 or controlled plungers. The servos 4 are cabled 5 to a control system that is not shown.

A important characteristic of the embodiment shown in FIG. 1 is its ability to respond to not only pitching and rolling motion, but also to vertical motion, that is motion up and down. The servos 4 are driven in and out longitudinally to adjust the platform (not shown) for pitch, roll, vertical displacement. The only limit on the platform's response to applied motion is its ability to respond. This is governed by the weight on the platform and the type of servo used. While any type of plunger servo can be used, it is essential that it be chosen to respond to the expected type of motion (ship, train, land vehicle) and to bear and move the expected weight on the platform.

Figure 2:
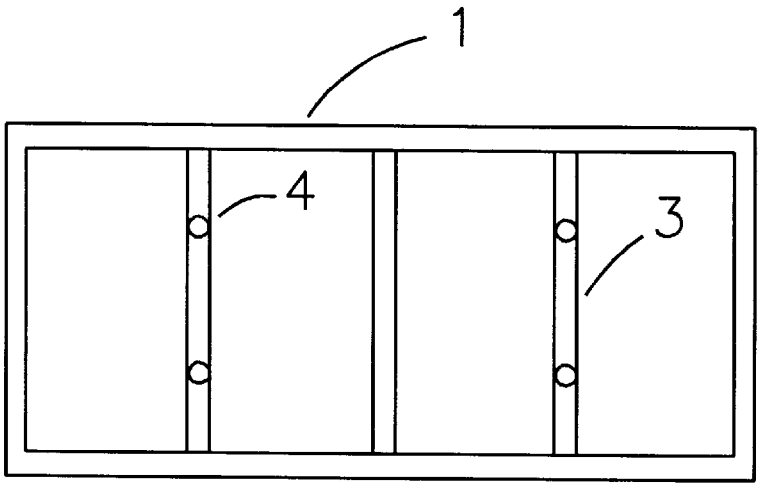
FIG. 2 is a top view of the embodiment shown in FIG. 1.

FIG. 2 shows a top view of the apparatus of FIG. 1. The apparatus frame 1 and the cross supports 3 can be clearly seen as can the location of the servos 4. It should be noted that any number of servos sufficient to maintain the apparatus 1 level with respect to the reference plane can be used. There is no particular number that is better than any other; with a larger apparatus, more servos must be used to supply force to position and support the apparatus. For ship and land vehicles, it is especially important to be able to combat up and down motions as well as pitching and rolling motions. A land vehicle is characterized by fast up and down accelerations and fast sideways jerks. A ship or pleasure craft is more prone to take large rolling motions, especially if anchored or sitting in a drift mode for fishing. On the other hand, a ship proceeding into high seas will experience tremendous pitching motion with only minor roll along with vertical or up/down motion.

It should be noted that a reclining chair of any type including a lounge chair can be attached to the platform. This chair can be used for entertainment, relaxation, escape from motion sickness, or therapeutic effect.

Figure 3:
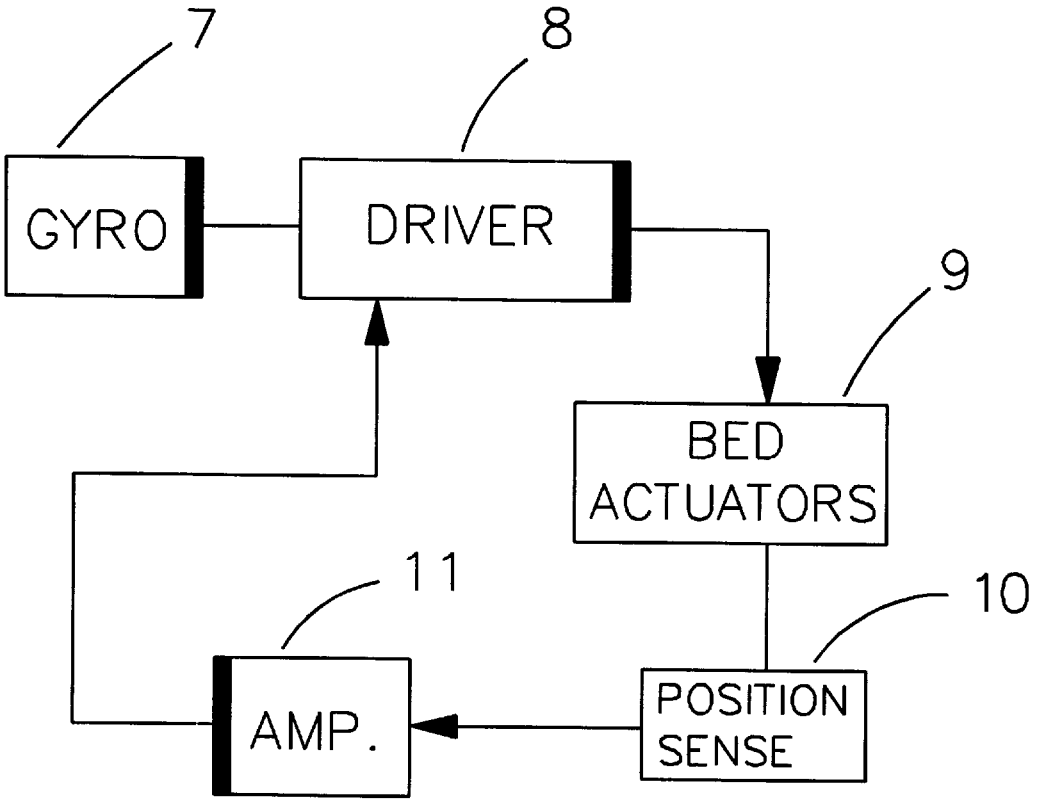
FIG. 3 is a block diagram of the control system of the embodiment of the invention shown in FIGS. 2 and 3.

FIG. 3 depicts a block diagram of an active control system that can be used to control the embodiment of the present invention shown in FIGS. 1 and 2. A gyro reference sensor, or other type of position sensor, 7 senses the position of the apparatus with respect to a predetermined reference plane such as a normally level position. The signal from this sensor 7 is amplified and processed by a driver circuit 8 to drive the set of extendable servos or solenoids called apparatus actuators 9. The apparatus actuators move the apparatus, and the difference between its new position and its old position is sensed by a position sensor 10. This can be any type of sensor that can measure a change in position of the apparatus. The position sensor 10 feeds a signal to an amplifier 11 that conditions it into an optimum level feedback signal. This signal is then fed back into the driver 8 so that equilibrium can be maintained.

Figure 4:
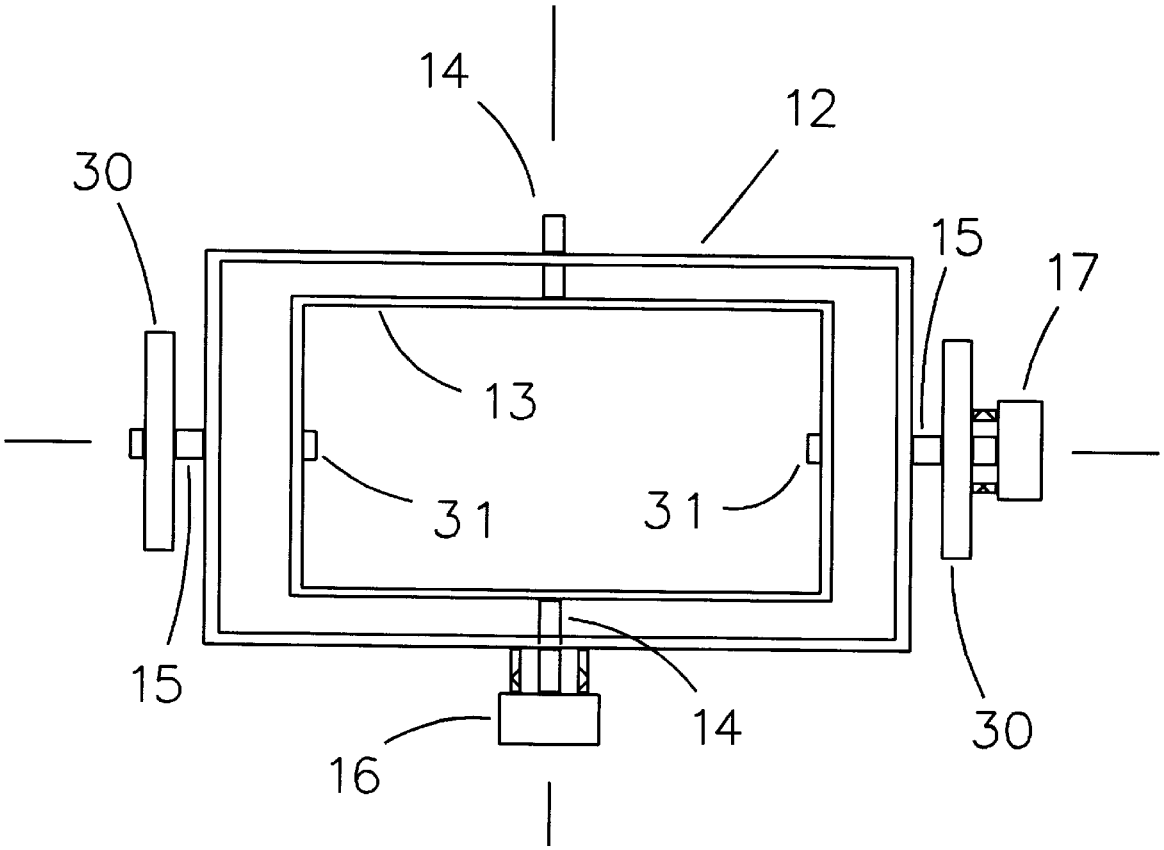
FIG. 4 shows an x-y gimbal base or support for gimbal embodiment of the invention.

FIG. 4 shows a different embodiment of the present invention. Here a set of x-y gimbals is equipped with dampers 16, 17. The gimbal consists of an outer frame 12 and an inner frame 13. The inner frame 13 is free to pivot around the x axis which is vertical in FIG. 4. The inner frame 13 pivots on shafts 14 and bearings (not shown). Attached to one of the x axis shafts 14 can be a damping chamber 16 that can be filled with a damping liquid. The outer frame 12 rotates on shafts 15 and bearings (not shown) around the y axis which is horizontal in FIG. 4. One of the shafts 15 can also be attached to a damping chamber 17 filled with liquid for damping. The damping chambers 16 and 17 prevent oscillation and overshoot in the motion. The damping chamber 17 is fixedly attached to a frame support 30. This frame support, and an identical one at the other end of the assembly, is securely attached to the deck, overhead, or other motion surface. These frame supports 30 support the entire assembly and couple it to the motion surface. The damping chamber 17 is thus fixed with respect to the motion surface. The other damping chamber 16 is only fixed with respect to the outer frame 12, and thus moves with when it moves. Damping chamber 17 damps the motion of the outer frame 12, and damping chamber 16 damps the motion of the inner frame 13. Vertical struts 31 extend downward (into the paper in FIG. 4) and are attached to a platform. Both frames can be locked to a fixed position when weight is being added to the apparatus. If a large mass is attached to the inner frame so that its center of gravity stays approximately at its center, the free gimbal motion of the assembly causes the apparatus to stay level when the base or deck that the frames are attached to moves.

Figure 5:
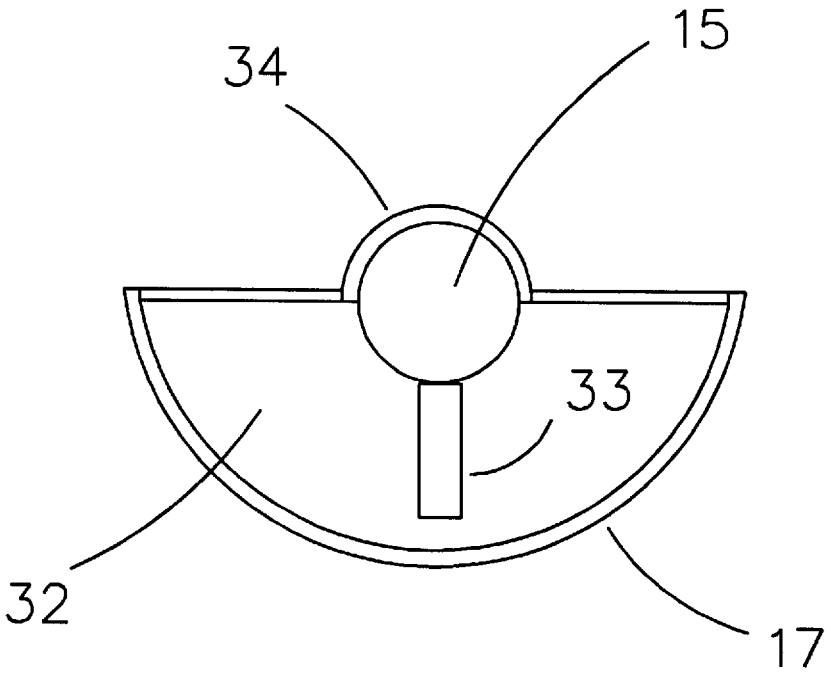
FIG. 5 depicts a liquid motion damper from the embodiment of FIG. 4.

FIG. 5 shows a cross section of one of the damping chambers 17. The details of the other damping chamber 16 are similar. The chamber comprises a half cylindrical space 32 that is filled with a liquid. The frame shaft 15 passes through this space via a bearing 34 and is free to rotate with respect to the chamber 17. A vane 33 is attached to the shaft 15 and moves in the liquid when the shaft rotates. The friction of the vane moving through the liquid causes a damping force due to the viscosity of the liquid. Various liquids of different viscosities can be used in this application. While water can be used, it is not recommended because of corrosion. A hydraulic fluid is better suited to this application.

Figure 6:
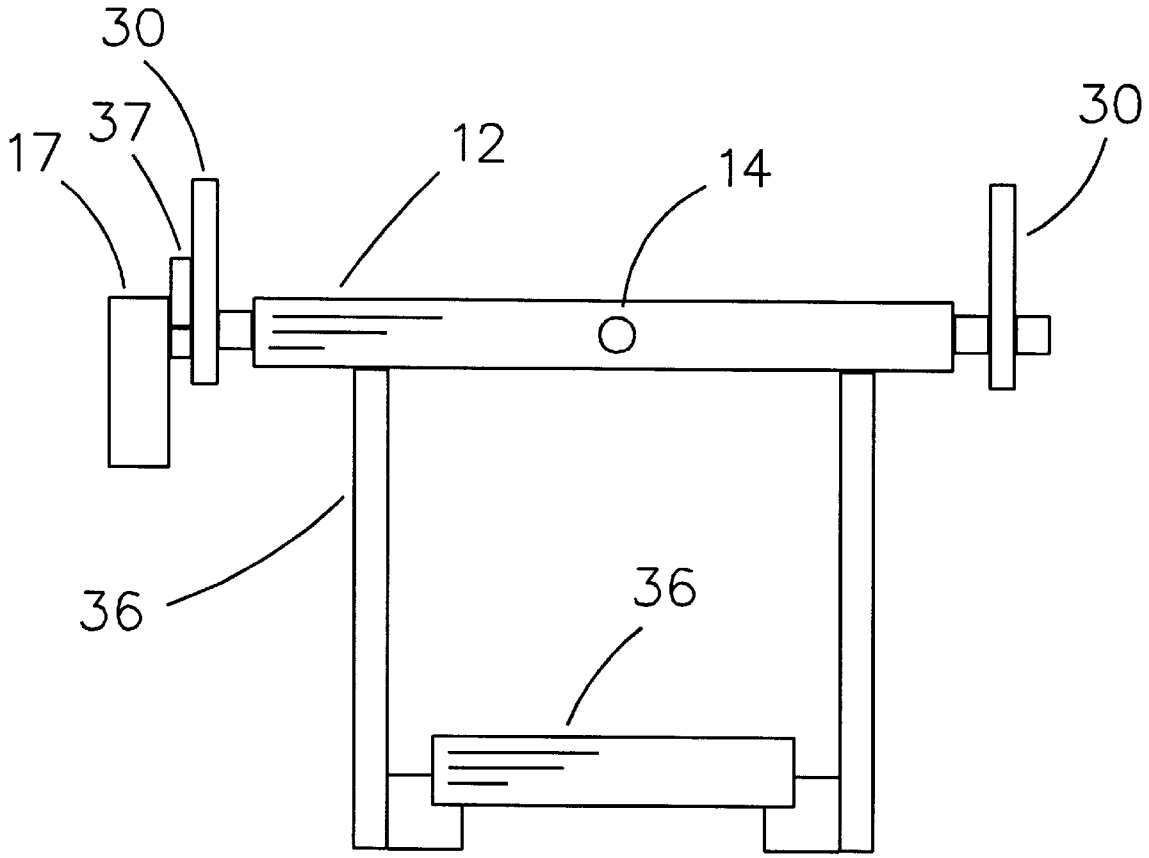
FIG. 6 shows a suspended platform for the embodiment of FIG. 4 and is a side view of the same.

FIG. 6 shows the platform that is attached below the gimbal mount of FIG. 4. The gimbal mount outer frame 12 is clearly seen as well as one damping chamber 17. The motion compensated platform 36 is suspended beneath the frame by vertical struts 31. The frame is fixedly mounted to a cabin or compartment ceiling or overhead with mounting brackets 30. The alternate axis shaft 14 is also clearly seen. A mounting bracket 37 for the damping chamber 17 can also be seen.

A very important embodiment of the present invention results when a chair that can be similar to a lounge chair is mounted on the platform 36 of FIG. 6. The chair can be reclined, and an occupant can totally relax protected for the pitching, rolling motion of the craft or vehicle. While a reclining type lounge chair is preferred, any type of chair or seat can be used. A more conventionally stool type seat or chair with straight back might be preferred if the apparatus is mounted on the aft of a pleasure craft and used for fishing. A motion sensitive person could enjoy a day of sport fishing without succumbing to seasickness.

Figure 7:
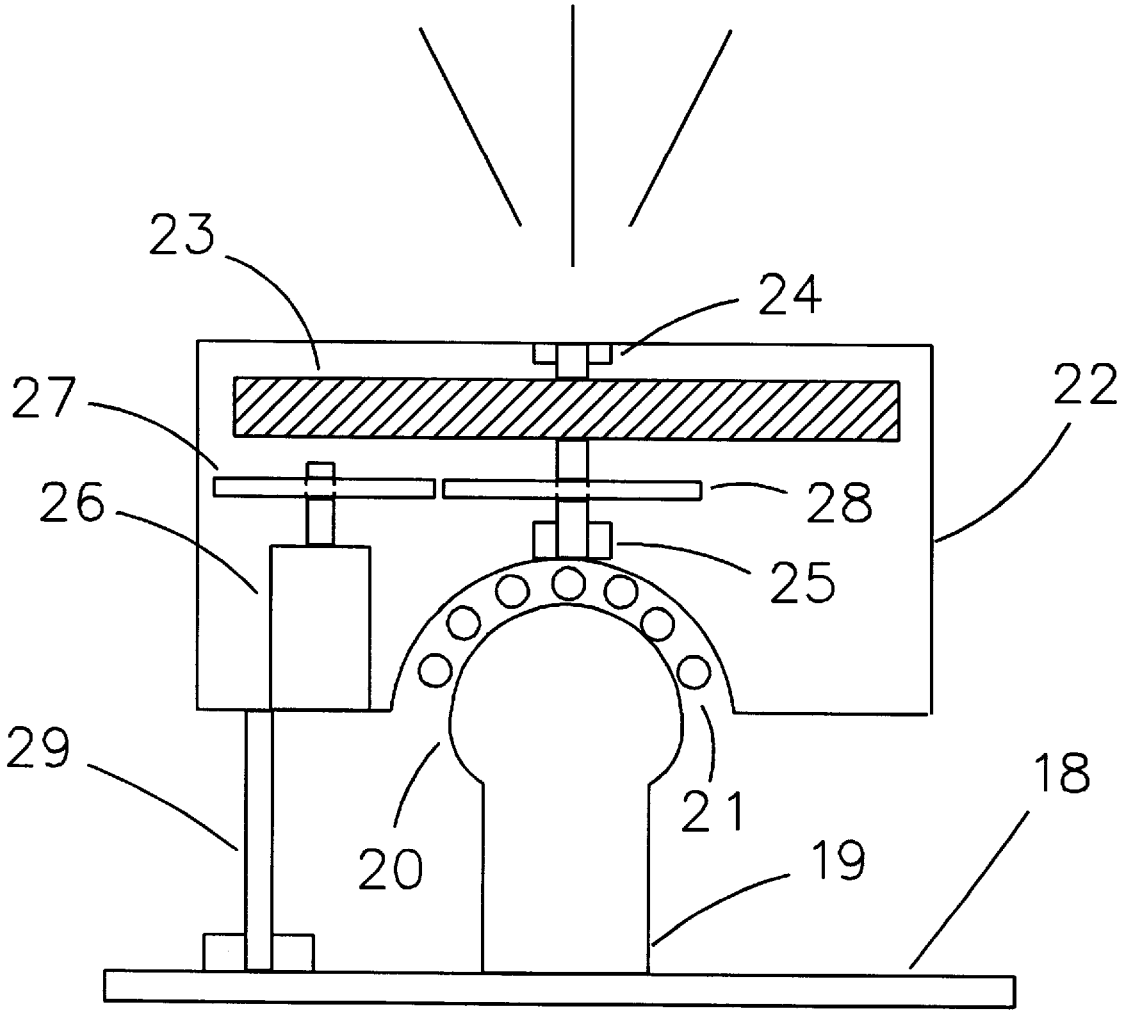
FIG. 7 depicts an evacuated box containing a rotating gyroscopic mass mounted on a pair of spherical bearings in another embodiment of the invention.

A different embodiment of the present invention is shown in FIG. 7. Here a first spherical bearing 20 is mounted on a tower 19 that is securely attached to the deck or motion surface 18. The spherical bearing 20 is in cooperation with an assembly of bearing balls 21 that form the actual contact surface of the bearing. Above the first bearing 20 and the balls 21 is a hollow box 22 with a concave spherical bottom that forms a second spherical bearing surface. In this configuration, the hollow box 22 is free to swivel in all directions with respect to the deck or motion surface 18. Inside the box 22 a gyroscopic mass 23 is mounted on a shaft and bearings 24 and 25. The box 22 can optionally have all the air evacuated to reduce drag on the gyroscope 23. On the shaft of the gyroscope 23 can be a friction drive wheel 28 that contacts another friction drive wheel 27 on the shaft of a motor 26. This can be any type of motor with an electric motor being preferred. The motor 26 and friction drives 27 and 28 cause the gyroscopic mass 23 to revolve at high speed. The preferred rotational velocity is between 10,000 and 20,000 RPM based on the mass; however, other angular velocities are possible. In any case, the mass 23 must be highly balanced to prevent any torque that would cause the bearings 24 and 25 to wear.

When the gyroscopic mass 23 is rotating at high angular velocity, the gyroscopic action of that mass causes the box 22 to remain at a predetermined angle with respect to the deck or motion surface 18. This causes a apparatus attached to the box to compensate of any motion of the surface 18.

It should be understood that the embodiment of FIG. 7 can also compensate for vertical or up/down motion by placing the apparatus of FIG. 1 or simply the servos of FIG. 1 and FIG. 2 on the box. Hence, a bed, chair, or platform that can completely compensate for external motion can be formed from the embodiment of FIG. 7.

It is clear that stationery designs of the present invention can be used aboard cruise ships for comfort or for entertainment in, for example, a movie theater. The equipment thus operates with two definite purposes: 1) entertainment, 2) therapeutic or for comfort.

An embodiment of the invention comprising a reclining seat that is motion stabilized could have reclining capabilities, and could contain specialized components such as stereo headphones (for optional sounds or music to soothe or distract from the nausea associated with motion sickness), and could contain private screening equipment to personalize entertaining distractions to the user.

Portable embodiments of the present invention can be used aboard private-pleasure craft, commercial or charter fishing boats, sightseeing vessels, ferries, commercial research vessels, and freighters for both sensitive cargo and passengers. A sleeping type arrangement or bed embodiment of the present invention could be used on private-pleasure craft, cruise ships and any other local where motion is a problem such as trucks, trains, and buses. An entertainment embodiment could be used aboard cruise ships for diversion. The present invention can be embodied as lounge furniture for expensive private-pleasure craft and cruise ships. The present invention can also be used as a stabilized bathtub that keeps water level and from sloshing.

It is to be understood that the above-described arrangements are merely illustrative of the application of the principles of the invention, and that other arrangements may be devised by those skilled in the art without departing from the spirit and scope of the invention.

We claim:

1. A shipboard motion compensated bed comprising, in combination:

a base firmly attached to a ship deck;

a plurality of extendable positioners attached to said base;

a reference plane perpendicular to gravitational acceleration;

a carrier attached to said extendable positioners, whereby said carrier can take an angle from a predetermined range of angles with respect to said base and a vertical acceleration from a predetermined range of accelerations, said range of angles being determined according to typical angles encountered on ships; said range of accelerations being determined by accelerations encountered on ships;

a sleeping platform firmly attached to said carrier;

at least one sensor referred to said reference plane to sense an instantaneous angle of the carrier with respect to said reference plane;

at least one sensor to sense an instantaneous linear acceleration of the carrier;

a control system with input and output, said input coupled to said sensors; said output coupled to said extendable postitioners such that said control system causes the extendable postitioners to keep the carrier substantially parallel to said reference plane while canceling linear acceleration, whereby said sleeping platform remains level with respect to said reference plane and experiences substantially no pitch acceleration.

2. The motion compensated bed claimed in claim 1 wherein said sleeping platform acts as a bed for a human.

3. The motion compensated bed claimed in claim 1 wherein said sleeping platform acts as a bed for an animal.

4. A shipboard motion compensated seat comprising, in combination:

a base firmly attached to a ship deck;

a plurality of extendable positioners attached to said base;

a reference plane perpendicular to gravitational acceleration;

a carrier attached to said extendable positioners, whereby said carrier can take an angle from a predetermined range of angles with respect to said base and a vertical acceleration from a predetermined range of accelerations, said range of angles being determined according to typical angles encountered on ships; said range of accelerations being determined by accelerations encountered on ships;

a chair firmly attached to said carrier;

at least one sensor referred to said reference plane to sense an instantaneous angle of the carrier with respect to said reference plane;

at least one sensor to sense an instantaneous linear acceleration of the carrier;

a control system with input and output, said input coupled to said sensors; said output coupled to said extendable postitioners such that said control system causes the extendable postitioners to keep the carrier substantially parallel to said reference plane while canceling linear acceleration, whereby said chair remains level with respect to said reference plane and experiences substantially no pitch acceleration.

5. The motion compensated seat claimed in claim 4 wherein said chair is a reclining lounge chair.

6. The motion compensated seat claimed in claim 5 further comprising stereo headphones attached to said lounge chair providing soothing music to a user.

7. The motion compensated seat claimed in claim 5 further comprising private screening equipment to provide distracting entertainment to a user.

* * * * *